US008770110B2

(12) United States Patent
Ames et al.

(10) Patent No.: US 8,770,110 B2
(45) Date of Patent: Jul. 8, 2014

(54) SELECTABLE YIELD WARHEAD AND METHOD

(75) Inventors: Richard Ames, Tucson, AZ (US); Craig L. Wittman, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 140 days.

(21) Appl. No.: 13/422,389

(22) Filed: Mar. 16, 2012

(65) Prior Publication Data

US 2013/0239837 A1 Sep. 19, 2013

(51) Int. Cl.
*F42B 12/02* (2006.01)

(52) U.S. Cl.
USPC ..... 102/478; 102/479

(58) Field of Classification Search
USPC ..... 102/473–529
See application file for complete search history.

(56) References Cited

U.S. PATENT DOCUMENTS

| | | | | |
|---|---|---|---|---|
| 4,145,972 | A | 3/1979 | Menz et al. | |
| 4,282,814 | A | 8/1981 | Menz et al. | |
| 6,283,036 | B1 * | 9/2001 | Munsinger | 102/479 |
| 6,615,738 | B2 | 9/2003 | Lecume | |

* cited by examiner

*Primary Examiner* — Samir Abdosh
(74) *Attorney, Agent, or Firm* — Renner, Otto, Boisselle & Sklar LLP

(57) ABSTRACT

A warhead 10 with selectable output can provide either a high-yield mode for a wide area of damage or a low-yield mode for restricting damage to a confined area. The warhead 10 includes a casing 14 having one or more partitions 16 that separate the casing 14 into multiple compartments. Each compartment includes an explosive charge. The multiple compartments include at least a first compartment 20 with a first explosive charge 22 and a first igniter 30, and a second compartment 24 separate from the first compartment 20 with a second explosive charge 26 and a second igniter 32. The second compartment 24 has a deflagration charge 34 for selectively destroying the second explosive charge 26 without detonation.

7 Claims, 5 Drawing Sheets

SELECTABLE YIELD WARHEAD AND METHOD

FIELD OF THE INVENTION

The present invention relates generally to warheads, and more particularly, to controlling initiation of warhead detonation.

BACKGROUND

A warhead is that part of a bomb, missile, projectile, torpedo, or other munition that contains an explosive charge. In many modern warheads, often it is important to achieve a high energy detonation to provide a maximum destructive effect over a maximum area from the amount of explosive carried by the warhead. Fragmentation explosives generally have a metal casing housing the explosive charge. When the explosive is detonated, the casing breaks into many small fragments, which detonation of the explosive thrusts outward at high speed with destructive effect. The higher the velocity of the fragments, the more intensely and more widespread those effects are felt.

SUMMARY OF THE INVENTION

Explosive weapons, which we will refer to as warheads, generally are designed to produce destructive effects over large areas to cover as much of a battlefield as possible and to overcome inaccuracies in delivering the warhead over a large distance. Improved targeting and delivery systems now make is easier to more precisely deliver warheads to a target. As a result, there are circumstances, such as when these weapons are deployed in urban areas, when the warfighter prefers to confine the destructive effects to the region immediately surrounding the intended target, or to minimize collateral damage. The present invention provides a warhead with selectable output, either a high-yield mode for a wide area of damage or a low-yield mode for restricting damage to a confined area.

The present invention also prevents or minimizes the possibility of unexploded explosive material in the low-yield mode by deflagrating a portion of the explosive charge. The warhead is divided into two or more compartments, each of which can be initiated independently. In a low-yield mode, deflagration charges in one or more compartments consume the explosive charge in the selected compartments before detonating the explosive charge is detonated in one or more other compartments. A separation barrier prevents unintended detonation transfer from one compartment to another, thereby ensuring reliable low-yield operation when fewer than all chambers are detonated. The deflagration charges burn up or otherwise consume the explosive charge without initiating an explosion, and thus preventing high-collateral damage fragmentation of adjacent portions of the casing, thereby reducing the amount of high-speed fragments and explosive force to provide low-yield effects when that mode is required. The dual-mode booster and deflagration charges also provide multiple initiation points in the deflagrating compartment, thereby ensuring that all the non-detonating explosive is consumed and there is minimal or no unexploded ordinance after detonation.

Accordingly, one aspect of the invention provides a warhead that includes a casing having one or more partitions that separate the casing into multiple compartments. Each compartment includes an explosive charge. The multiple compartments include at least a first compartment with a first explosive charge and a first igniter, and a second compartment separate from the first compartment with a second explosive charge and a second igniter. The second compartment has a deflagration charge for selectively destroying the second explosive charge without detonation.

Optionally, the partition insulates the second explosive charge in the second compartment to prevent detonation of the explosive charge in an adjacent compartment from deflagration of the second explosive charge in the second compartment.

As another option, the deflagration charge includes linear-shaped charges interposed between the casing and the second explosive charge to rupture the casing and initiate deflagration of the second explosive charge, and/or the deflagration charge includes a pyrotechnic charge.

According to another aspect of the invention, a method for activating a selectable yield warhead, includes the following steps: (a) providing a warhead that includes a casing having one or more partitions that separate the casing into multiple compartments, each compartment including an explosive charge, and the multiple compartments include at least a first compartment with a first explosive charge and a first igniter, and a second compartment separate from the first compartment with a second explosive charge and a second igniter, the second compartment having a deflagration charge; (b) selectively initiating the deflagration charge in the second compartment; and (c) initiating the first igniter to cause detonation of the first explosive charge in the first compartment of the warhead.

Optionally, the method includes the steps of: (a) initiating the deflagration charge; and (b) initiating the first igniter after a predetermined delay following initiation of the deflagration charge.

As another option, the method includes the steps of: (a) initiating the second igniter to detonate the second explosive charge; and (b) initiating the first igniter to detonate the first explosive charge substantially simultaneously.

The step of initiating the deflagration charge may include rupturing the casing.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

Figures 1, 2, 3:
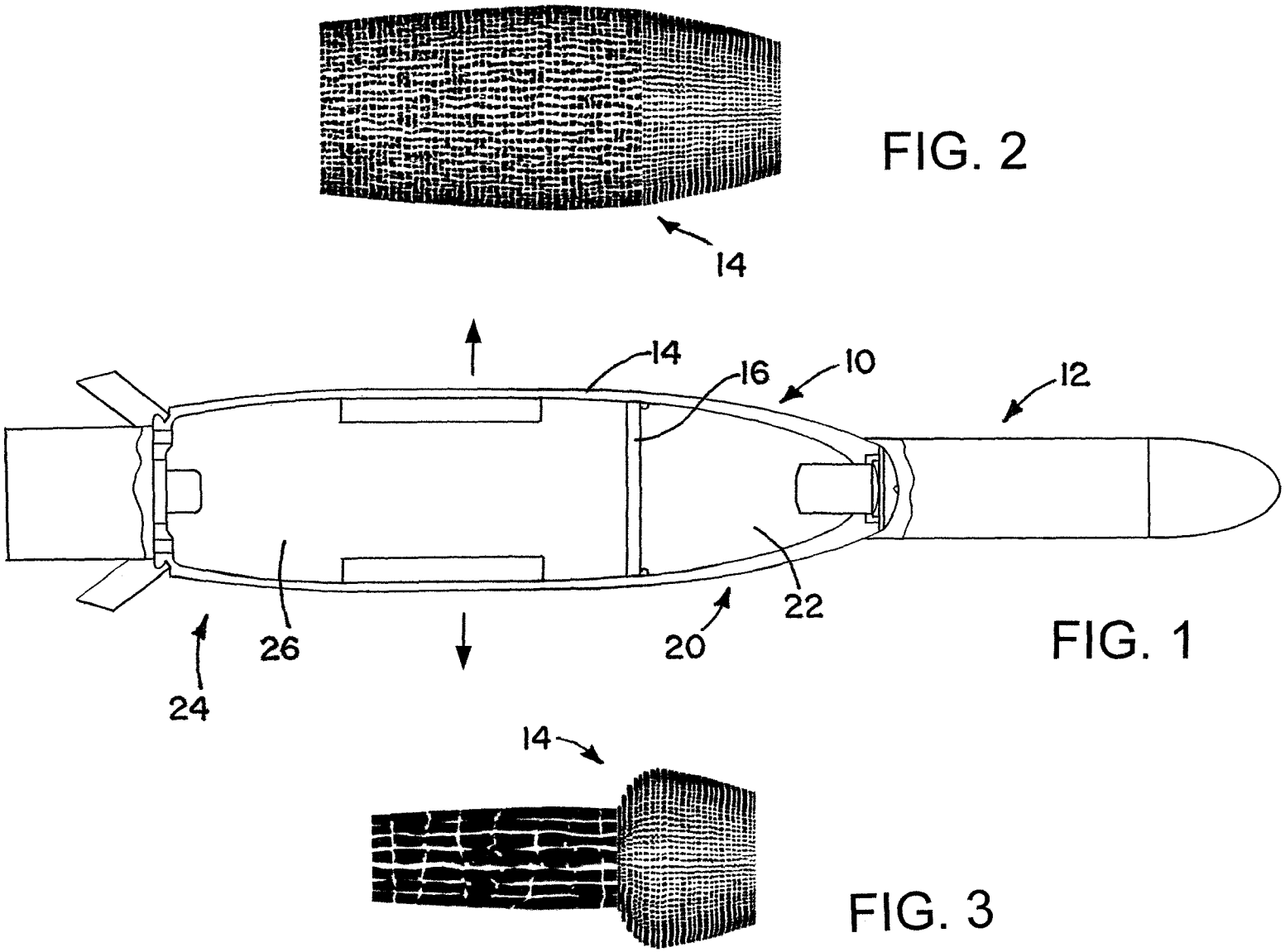
FIG. 1 is a schematic illustration, partially in section, of a warhead provided in accordance with the invention, incorporated into a missile.
FIG. 2 is an illustration of a casing fragmentation pattern for the warhead of FIG. 1 in a high-yield mode.
FIG. 3 is an illustration of a casing fragmentation pattern for the warhead of FIG. 1 in a low-yield mode.
Figure 5:
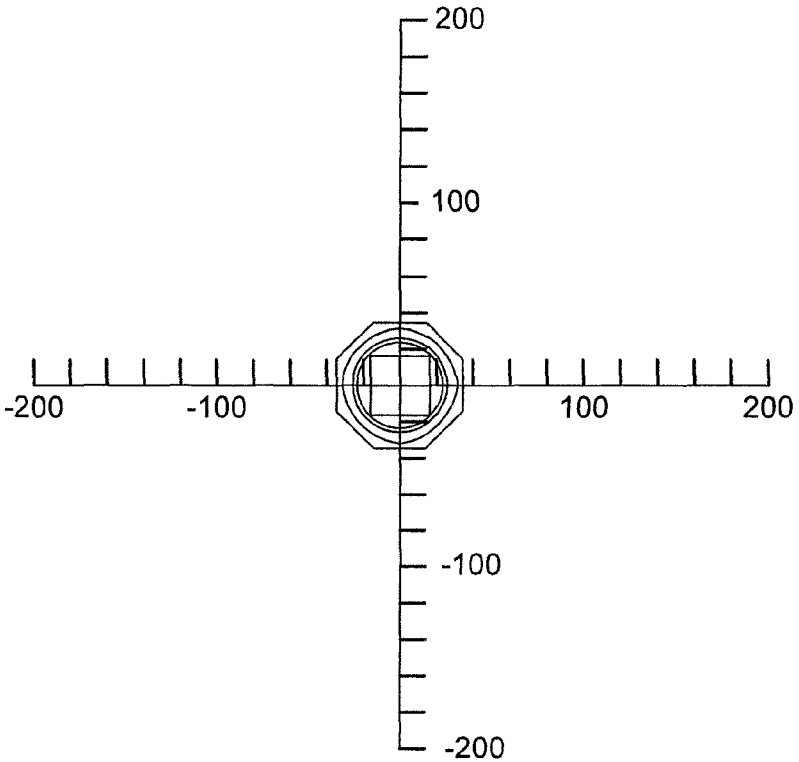
FIG. 5 is a graphical illustration of a precision destructive effect radius provided by the warhead of FIG. 1 in a low-yield radius.

The present invention provides a warhead capable of producing a variable output that is selectable at the time of deployment. Such a capability allows the same warhead to be used for large area high-yield destructive effects as well as precision low-yield destructive effects when collateral damage is a concern. This concept can be integrated into existing warheads with minor modifications to the current fuse and the addition of a partition. Consequently, the present invention separates the warhead into two or more compartments and detonates only those necessary to achieve the desired effects. The warhead can be provided in a missile, torpedo, rocket, projectile, or other munitions which contains an explosive charge and a detonator for initiating an explosion of the explosive material that makes up the explosive charge.

To provide a large lethal radius, the full yield of the warhead is desired. An explosive charge is detonated to generate a shockwave that shatters the casing into small, high velocity fragments are projected outward at a high speed. To minimize collateral damage in a relatively smaller lethal radius, the yield of the warhead is reduced so as to provide larger, lower-speed casing fragments from one or more compartments, while the smaller, high speed "shotgun" fragments continue to be ejected outward from the another compartment or compartments.

To reduce the yield, rather than detonate the explosive charge, deflagration is initiated in one or more compartments. During a deflagration, the explosive charge burns quickly and at a high temperature, which consumes the explosive charge without generating a shockwave that is sufficient to shatter the casing into high velocity fragments. Pressure generated from the deflagration can burst the casing, or shaped charges can be used to rupture the casing in a more controlled manner.

This is a general description only because the line between deflagration and detonation is imprecise. In general, deflagrations are thermal reactions that occur at speeds depending largely on the chemistry of the explosive charge. These speeds typically are less than the speed of sound in the explosive material, building pressure, particularly in confined spaces like the casing, and high temperatures as the explosive charge is consumed. In a detonation, however, the reaction speeds typically are higher than the speed of sound in the explosive material and thus create a shockwave that accelerates the propagating explosive reaction and produces higher temperatures and pressures than a deflagration. Some materials and some situations of temperature and confinement can transition from deflagration to detonation, and the partition provided between the compartments is intended to prevent the deflagration of the explosive charge in one compartment from initiating a detonation in an adjacent compartment.

Referring now to the drawings in detail, and initially FIGS. 1-5, an exemplary warhead 10 provided by the invention is shown incorporated in a missile 12. The missile 12 may include one or more sensors, a guidance system, a rocket motor, and control fins, and other components, for delivering the warhead to a desired target. The warhead 10 generally includes a housing or casing 14 that contains an explosive material or explosive charge. The casing 14 is separated by a partition 16 into two compartments or chambers. A forward, or first compartment 20, always produces detonation of a first explosive charge 22 at (a) the same time as a rear or second compartment 24 with a second explosive charge 26 either produces detonation or (b) after the explosive charge 26 in the second compartment 24 has been exhausted in a deflagration initiated in advance. Thus, the explosive charges 22 and 26 in the front and rear compartments 20 and 24 can be detonated to create an explosion that fractures the casing 14 and produces many high velocity and relatively small fragments for maximum effect in a high-yield mode. Alternatively, the explosive charge 26 in the rear compartment 24 can be burned or deflagrated to minimize the speed and increase the size of the fragments of the casing 14 adjacent the deflagrating rear compartment 24 to reduce the area impacted by the warhead 10, since only the explosive charge in the front compartment 20 is detonated to provide a reduced explosive effect.

Figure 4:
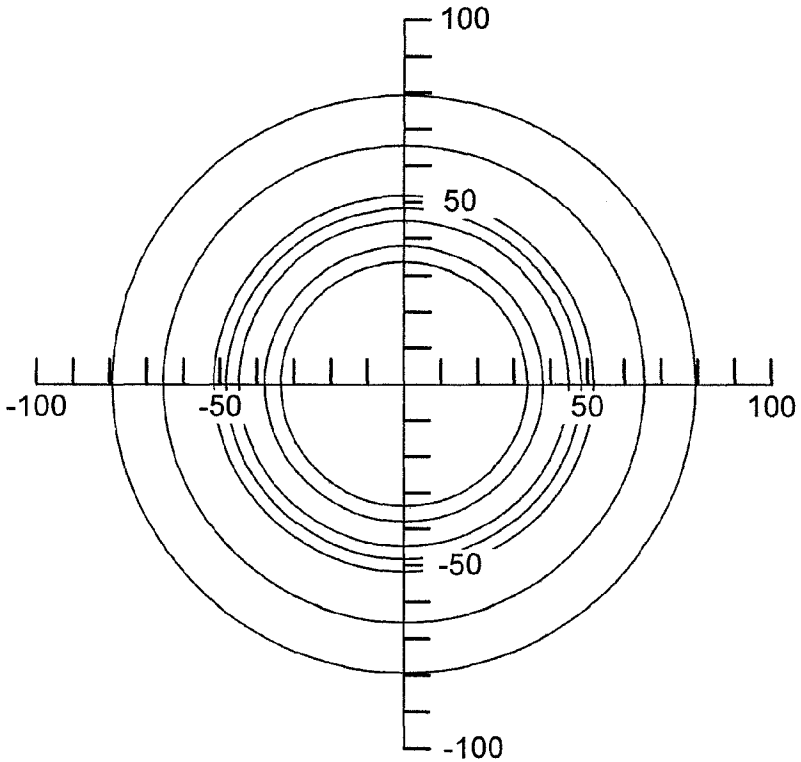
FIG. 4 is a graphical illustration of a large destructive effective radius provided by the warhead of FIG. 1 in a high-yield mode.

An exemplary fracture pattern provided in a high-yield mode is shown in FIG. 2, and the area effected by such an explosion is illustrated in FIG. 4. The central circle is the area of maximum destructive effect and that destructive effect decreases with distance from the center. An exemplary fracturing pattern for the casing in a low-yield mode is shown in FIG. 3 and the area effected is greatly reduced, as graphically illustrated in FIG. 5.

Figure 6:
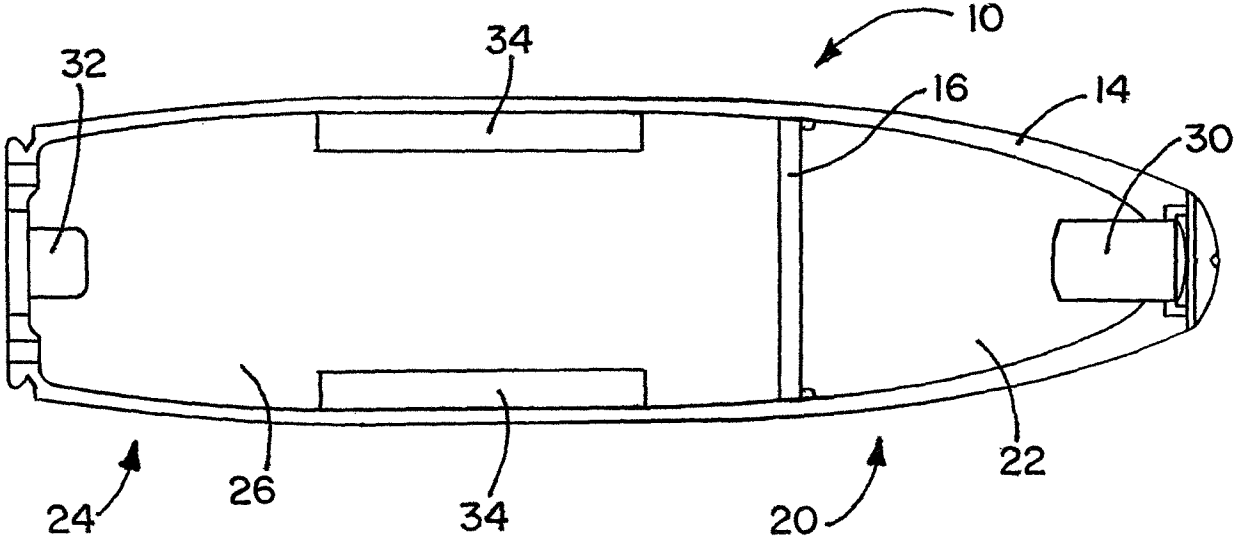
FIG. 6 is an enlarged schematic representation of the warhead of FIG. 1 shown in the section.

Further details of an exemplary warhead 10 will be described with respect to FIG. 6. The warhead 10 shown in FIG. 6 includes the first compartment 20 having the first explosive charge 22 and the second compartment 24 having the second explosive charge 26 separated by the partition 16. The first chamber 20 with the first explosive charge 22 also includes an igniter 30, which we will refer to as the first igniter 30, for initiating an explosion of the first explosive charge 22, which in turn fractures or shatters the casing 14 to produce many small fragments that are thrown outwardly at a high velocity. The igniter also may be referred to as an initiator or a booster. The second chamber 24 also includes an igniter 32, the second igniter 32, that can initiate an explosion of the second charge 26 in the second chamber 24 to similarly fracture the casing 14 surrounding the second chamber 24 for a high-yield effect. The missile or warhead may include a controller that controls the igniters in the warhead.

The second chamber 24 also includes one or more deflagration charges 34, typically at outside edges of the explosive charge and adjacent an inner surface 36 of the casing 14. The deflagration charges 34 initiate burning of the explosive charge 26 without detonation, using pyrotechnic charges, for example, and also may breach the casing 14 to relieve any excess pressure generated by the deflagrating explosive or by the initiation of the deflagration charge 34. The deflagration charges 34 can include shaped charges to breach the casing in a predetermined pattern.

The use of shaped charges improves the reliability of a low-yield mode of operation when required to limit collateral damage, whereas a pyrotechnic ensures that the explosive charge in the deflagrating compartment will burn away, thereby limiting the risk of unexploded ordinance. By initiating the deflagration first and then the detonation, the probability that the non-detonating compartment will not completely burn by the time the weapon impacts the target is minimized.

The partition 16 or other separator barrier between the first compartment 20 and the second compartment 24 has sufficient mechanical strength to maintain the separate nature of the compartments, while also providing insulation to minimize the chance that the deflagration in the second compartment 24 could initiate detonation in the first compartment 20.

As noted above, the first compartment 20 and the accompanying first explosive charge 22 always produces detonation of an explosive nature, and the second compartment 24 either can produce an explosive detonation or remain inactive as the deflagration charges 34 initiate a deflagration to burn up the explosive before the explosive charge 26 has an opportunity to detonate. The deflagration charges 34 can include shaped charges or pyrotechnics that can breach the casing in the second compartment 24 to relieve pressure from the deflagration and the gasses produced thereby and to prevent the deflagration from becoming a detonation. Consequently, these shaped charges can be used to rupture the casing 14 and ensure that no or larger fragments are produced from the deflagration in the second compartment 24 of the casing 14. In addition, rupturing the casing 14 reduces or eliminates the likelihood that confinement would trigger deflagration-to-detonation transition. Depending on the type of explosive charge and its deflagration behavior, however, it might not be necessary to rupture the casing 14.

This warhead design provided by the present invention does not require any new exotic materials and generally makes use of proven off-the-shelf technologies in a new way to provide either a full yield, where all explosive charges are detonated to produce a high-intensity shockwave and ejecting many small fragments at high speed to produce a lethal effect over a large area, or a deflagration in the one or more compartments of the warhead and a detonation only in one or more other compartments of the warhead so that nonlethal fragmentation of the casing is produced in the deflagrating compartments to consume the explosive charge before the other explosive charge or charges are detonated, providing a reduced-intensity explosive shockwave and fewer lethal fragments from the casing.

In summary, the present invention provides a warhead 10 with selectable output that can provide either a high-yield mode for a wide area of damage or a low-yield mode for restricting damage to a confined area. The warhead 10 includes a casing 14 having one or more partitions 16 that separate the casing 14 into multiple compartments. Each compartment includes an explosive charge. The multiple compartments include at least a first compartment 20 with a first explosive charge 22 and a first igniter 30, and a second compartment 24 separate from the first compartment 20 with a second explosive charge 26 and a second igniter 32. The second compartment 24 has a deflagration charge 34 for selectively destroying the second explosive charge 26 without detonation.

The concept for a warhead provided by the invention can be applied to almost any weapon that uses an explosive-filled warhead, although at present the most advantage appears to be in larger explosive weapon classes.

Figure 7:
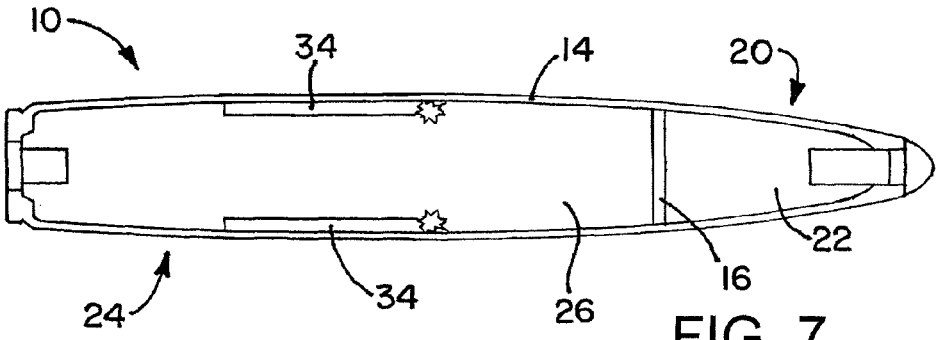
FIGS. 7-11 are sequential schematic illustrations of fragmentation control during an initiation sequence in a low yield mode of a warhead provided in accordance with the present invention.
Figure 8:
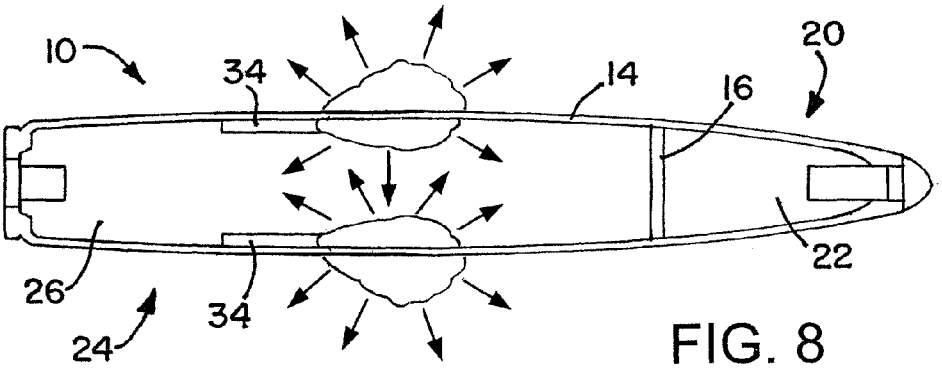
Figure 9:
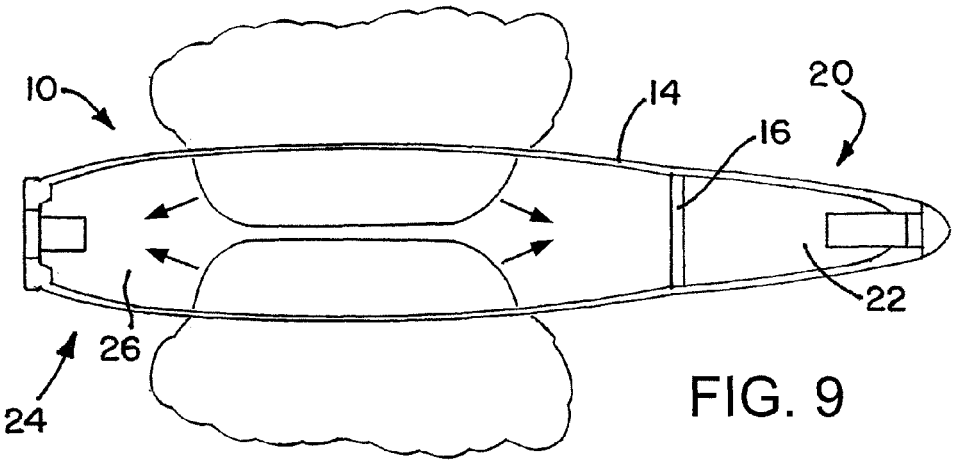
Figure 10:
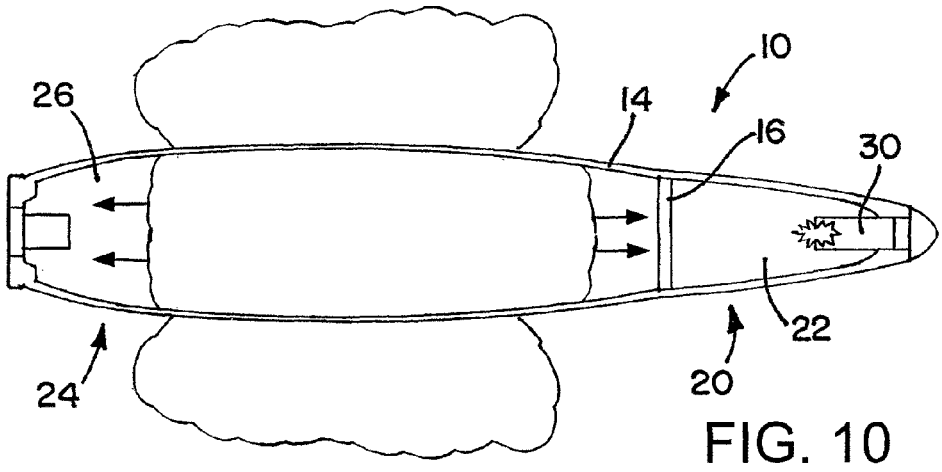
Figure 11:
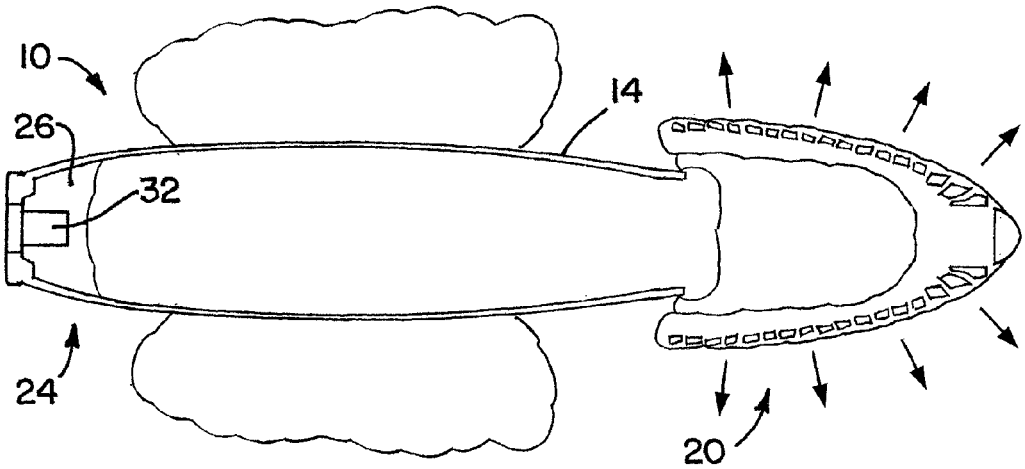

An exemplary process for a low-yield mode activation of the warhead 10 is illustrated in FIGS. 7-11. In FIG. 7, linear-shaped deflagration charges 34 are initiated at one end at a time of zero microseconds. At 25 microseconds, shown in FIG. 8, the deflagration charges 34 have perforated the casing 14 and deflagration has begun from the point where the deflagration charges 34 were ignited. At time t=100 ms, shown in FIG. 9, the deflagration continues to spread through the explosive charge 26 in the second compartment 24 consuming and depleting the explosive charge 26 as it progresses. The partition 16 contains the deflagration in the second compartment 24. Gases produced by the deflagration process are ejected through the opening in the ruptured casing 14. As shown in FIG. 10, at time t=1 s, deflagration of the second explosive charge 26 in the second compartment 24 is nearly complete as the igniter 30 in the first compartment 20 initiates detonation of the first explosive charge 22, and at 1.00002 seconds later the detonation in the forward compartment 20 produces high velocity fragmentation of the casing 14 surrounding the first compartment 20, as shown in FIG. 11. At this point, deflagration of the second explosive charge 26 is substantially complete and any transfer of the detonation of the first explosive charge 22 into the second compartment 24 is greatly reduced thereby reducing the fragmentation of the casing 14 surrounding the second compartment (see FIG. 3).

In summary, the present invention provides a system and method with one or more of the features set forth in the following clauses.

A. A warhead 10, comprising: a casing 14 having one or more partitions 16 that separate the casing into multiple compartments, each compartment including an explosive charge, and the multiple compartments include at least a first compartment 20 with a first explosive charge 22 and a first igniter 30, and a second compartment 24 separate from the first compartment 20 with a second explosive charge 26 and a second igniter 32, the second compartment 24 having a deflagration charge 34 for selectively destroying the second explosive charge 26 without detonation.

B. A warhead 10 as set forth in clause A or any other clause depending from clause A, where the partition 16 insulates the second explosive charge 26 in the second compartment 24 to prevent detonation of the explosive charge in an adjacent compartment from deflagration of the second explosive charge 26 in the second compartment 24.

C. A warhead 10 as set forth in clause A or any other clause depending from clause A, wherein the deflagration charge 34 includes linear-shaped charges interposed between the casing 14 and the second explosive charge 26 to rupture the casing 14 and initiate deflagration of the second explosive charge 26.

D. A warhead 10 as set forth in clause A or any other clause depending from clause A, where the deflagration charge 34 includes a pyrotechnic charge.

E. A method for activating a selectable yield warhead, comprising the steps of:

(a) providing a warhead 10, comprising: a casing 14 having one or more partitions 16 that separate the casing into multiple compartments, each compartment including an explosive charge, and the multiple compartments include at least a first compartment 20 with a first explosive charge 22 and a first igniter 30, and a second compartment 24 separate from the first compartment 20 with a second explosive charge 26 and a second igniter 32, the second compartment 24 having a deflagration charge 34;

(b) selectively initiating the deflagration charge 34 in the second compartment 24; and (c) initiating a first igniter 30 to cause detonation of the first explosive charge 22 in the first compartment 20 of the warhead.

F. A method as set forth in as set forth in clause E or any other clause depending from clause E, comprising the steps of:

(a) initiating the deflagration charge 34; and (b) initiating the first igniter 30 after a predetermined delay following initiation of the deflagration charge 34.

G. A method as set forth in clause E or any other clause depending from clause E, comprising the steps of:

(a) initiating the second igniter 32 to detonate the second explosive charge 26; and (b) initiating the first igniter 30 to detonate the first explosive charge 32 substantially simultaneously.

H. A method as set forth in clause F or any other clause depending from clause F, where the step of initiating the deflagration charge 34 includes rupturing the casing 14.

Although the invention has been shown and described with respect to a certain illustrated embodiment, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the illustrated embodiment of the invention.

We claim:

1. A warhead, comprising:

a casing having one or more partitions that separate the casing into multiple compartments, each compartment including an explosive charge, and the multiple compartments include at least a first compartment with a first explosive charge and a first igniter, and a second compartment separate from the first compartment with a second explosive charge and a second igniter, the second compartment having a deflagration charge for selectively destroying the second explosive charge without detonation, where the deflagration charge is positioned against the casing, and when ignited the deflagration charge ruptures the casing and initiates deflagration.

2. A warhead as set forth in claim 1, where the partition insulates the second explosive charge in the second compartment to prevent detonation of the explosive charge in an adjacent compartment from deflagration of the second explosive charge in the second compartment.

3. A warhead, comprising:

a casing having one or more partitions that separate the casing into multiple compartments each compartment including an explosive charge, and the multiple compartments include at least a first compartment with a first explosive charge and a first igniter, and a second compartment separate from the first compartment with a second explosive charge and a second igniter, the second compartment having a deflagration charge for selectively destroying the second explosive charge without detonation, where the deflagration charge is positioned against the casing, and the deflagration charge includes linear-shaped charges interposed between the casing and the second explosive charge, and when united the deflagration charge ruptures the casing and initiates deflagration of the second explosive charge.

4. A warhead as set forth in claim 1, where the deflagration charge includes a pyrotechnic charge.

5. A method for activating a selectable yield warhead, comprising the steps of:

(a) providing a warhead, comprising: a casing having one or more partitions that separate the casing into multiple compartments, each compartment including an explosive charge, and the multiple compartments include at least a first compartment with a first explosive charge and a first igniter, and a second compartment separate from the first compartment with a second explosive charge and a second igniter, the second compartment having a deflagration charge positioned against the casing to rupture the casing and to initiate deflagration;

(b) selectively initiating the deflagration charge in the second compartment to rupture the casing and to initiate deflagration in the second compartment; and (c) initiating a first igniter to cause detonation of the first explosive charge in the first compartment of the warhead.

6. A method as set forth in claim 5, comprising the steps of:

(a) initiating the deflagration charge; and (b) initiating the first igniter after a predetermined delay following initiation of the deflagration charge.

7. A method as set forth in claim 5, comprising the steps of:

(a) initiating the second igniter to detonate the second explosive charge; and (b) initiating the first igniter to detonate the first explosive charge substantially simultaneously.

* * * * *